US012687085B2

(12) United States Patent
Varghese

(10) Patent No.: US 12,687,085 B2
(45) Date of Patent: Jul. 21, 2026

(54) DOWNHOLE BALL RELEASE DEVICE

(71) Applicant: Schlumberger Technology Corporation, Sugar Land, TX (US)

(72) Inventor: Mathew Varghese, Abu Dhabi (AE)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/206,162

(22) Filed: May 13, 2025

(65) Prior Publication Data

US 2025/0347192 A1 Nov. 13, 2025

Related U.S. Application Data

(60) Provisional application No. 63/646,177, filed on May 13, 2024.

(51) Int. Cl.
*E21B 33/12* (2006.01)
*E21B 23/00* (2006.01)

(52) U.S. Cl.
CPC ..... *E21B 33/12* (2013.01); *E21B 23/00* (2013.01); *E21B 2200/08* (2020.05)

(58) Field of Classification Search
CPC ..... E21B 33/12; E21B 23/00; E21B 2200/08; E21B 33/1208
See application file for complete search history.

(56) References Cited

U.S. PATENT DOCUMENTS

| | | | | |
|---|---|---|---|---|
| 8,636,055 | B2 * | 1/2014 | Young | E21B 43/2607 15/104.062 |
| 9,708,894 | B2 * | 7/2017 | Ditzler | E21B 43/116 |
| 9,739,111 | B2 * | 8/2017 | Beason | E21B 43/2607 |
| 9,745,847 | B2 * | 8/2017 | Ditzler | E21B 43/26 |
| 9,810,036 | B2 * | 11/2017 | Mailand | E21B 43/119 |
| 9,903,186 | B2 * | 2/2018 | Zimmerman, Jr. | E21B 43/121 |
| 9,938,789 | B2 * | 4/2018 | Silva | E21B 43/27 |
| 9,970,279 | B2 * | 5/2018 | Naedler | E21B 34/14 |
| 10,309,174 | B2 * | 6/2019 | Burgos | E21B 41/00 |
| 10,428,623 | B2 * | 10/2019 | Silva | E21B 41/00 |
| 11,808,092 | B2 * | 11/2023 | King | E21B 17/021 |
| 12,140,020 | B2 * | 11/2024 | Loov | G01V 1/18 |
| 2009/0159297 | A1 * | 6/2009 | Fould | E21B 23/04 166/387 |
| 2011/0198099 | A1 * | 8/2011 | Zierolf | E21B 23/01 166/382 |

(Continued)

*Primary Examiner* — Steven A Macdonald
(74) *Attorney, Agent, or Firm* — Jeffrey D. Frantz

(57) ABSTRACT

A downhole sealing device includes a ball, a collet coupled to the ball, a release device, and an electrical control board. The device is configured to release the ball and collet onto a downhole plug seat during hydraulic fracturing. In operation, an electrical signal is sent to the release device, actuating the release of collet fingers. Pressure equalization occurs through ports in the ball before the ball and collet are released to seal the plug seat. The device may be used to enable relocation of a hydraulic fracture monitoring cable when high-risk conditions are detected. After sealing is achieved, the cable and monitoring equipment may be moved to a safer location without halting the fracturing operation. The ball and collet may later be milled to restore wellbore access. The system supports real-time actuation and may be compatible with addressable command signals for selective downhole operation.

14 Claims, 3 Drawing Sheets

(56) References Cited

U.S. PATENT DOCUMENTS

| | | | | |
|---|---|---|---|---|
| 2012/0217021 | A1* | 8/2012 | Cravatte | E21B 34/14 166/373 |
| 2014/0246189 | A1* | 9/2014 | Beason | E21B 33/068 166/75.15 |
| 2015/0068762 | A1* | 3/2015 | Naedler | E21B 43/267 166/373 |
| 2015/0136425 | A1* | 5/2015 | Burgos | E21B 23/10 166/381 |
| 2016/0061009 | A1* | 3/2016 | Ditzler | E21B 23/0414 166/381 |
| 2016/0061018 | A1* | 3/2016 | Ditzler | E21B 47/06 166/250.04 |
| 2016/0298406 | A1* | 10/2016 | Greening | E21B 41/00 |
| 2016/0312556 | A1* | 10/2016 | Silva | E21B 43/26 |
| 2018/0119521 | A1* | 5/2018 | Silva | E21B 41/00 |

* cited by examiner

DOWNHOLE BALL RELEASE DEVICE

CROSS-REFERENCE TO RELATED APPLICATIONS

The present document is based on and claims priority to U.S. Provisional Application No.: 63/646, 177, filed May 13, 2024.

BACKGROUND

Hydraulic fracture monitoring ("HFM") is used in subterranean oil and gas wellbores to analyze the spatial characteristics of induced fractures during hydraulic stimulation operations. By providing insight into fracture geometry and propagation, HFM facilitates optimization of well completions, supports accurate production forecasting, and enables informed decision-making during real-time treatment execution.

One method of implementing HFM involves the deployment of polymer-locked cables incorporating optical fibers within horizontal wellbores. These fiber-optic cables function as distributed sensors, capturing acoustic, strain, and temperature data that can be used to infer the location and behavior of fracture fluids. The information obtained can be utilized to evaluate the effectiveness of the stimulation treatment and to improve control over fluid placement during the fracturing process.

However, in certain conditions, such as when cluster efficiency is reduced, fracture fluids may flow at elevated velocities through specific sections of the wellbore. These high-velocity flows can result in localized erosion, particularly in zones where the optical fiber cables are directly exposed. Prolonged exposure to such conditions may compromise the structural integrity or sensing functionality of the cables, reducing their effectiveness for continued monitoring.

As a result, there is a need for a system for moving or relocating polymer locked cables during high risk events.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Illustrative examples of the subject matter claimed below will now be disclosed. In the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

The present disclosure relates to a downhole electromechanical release device deployable in horizontal or vertical wellbores during hydraulic fracturing operations. The device facilitates temporary sealing of a downhole plug while enabling repositioning or retrieval of polymer-locked cables incorporating optical fibers. The system minimizes the risk of damage to in-well monitoring infrastructure under conditions of high-velocity fluid flow, such as those associated with low cluster efficiency in multi-stage hydraulic fracture treatments.

In some embodiments, the system includes an electromechanical tool that can be positioned within the wellbore and actuated remotely from the surface. The device comprises multiple subcomponents designed to interact to provide selective deployment and release of a sealing ball, while simultaneously disengaging from the optical fiber cable system through a collet mechanism.

During hydraulic fracturing, polymer-locked cables—used to house and protect optical fibers for distributed acoustic sensing ("DAS"), distributed temperature sensing ("DTS"), or strain measurements—are susceptible to erosion, particularly when fluid velocities increase. This occurs when cluster efficiency is low, resulting in localized high flow rates near some perforation clusters. Prolonged exposure to such conditions may lead to structural degradation of the protective polymer layers, abrasion of the optical fiber core, or detachment of cable anchors.

Figure 1:
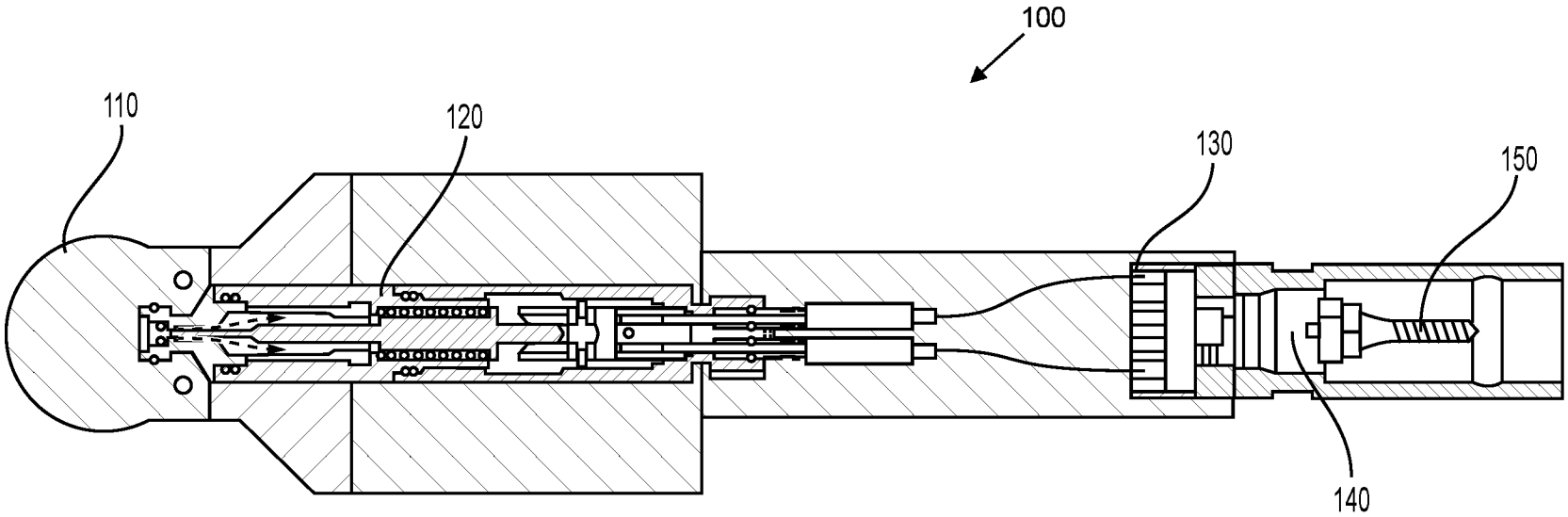
FIG. 1 is a diagram illustrating a seal ball drop device, according to one or more examples of the disclosure.

FIG. 1 is a diagram illustrating an example of a seal ball drop device 100 that enables withdrawal or repositioning of the cable from zones with elevated erosion potential. The device 100 achieves this by deploying a sealing ball 110 to a downhole plug seat to maintain pressure containment for the fracturing stage, while disengaging from the cable to allow its relocation.

The sealing ball 110 is coupled to the device 100 via a release mechanism comprising a release device 120 and an electrical control board 130. The release mechanism can be powered using electrical commands from the surface, either via simple voltage application or through an addressable control protocol. In some embodiments, the electrical control board 130 is configured with an addressable switch that requires a unique signal pattern to authorize release, allowing for precise control of actuation within complex downhole tool strings containing multiple devices.

Upon receiving the appropriate signal, the release device 120 actuates to uncouple the ball 110 from the device 100. In some versions, the ball 110 may include one or more flow ports or pressure-equalization holes. These ports allow fluid pressure on both sides of the ball to equilibrate prior to release, facilitating smooth deployment and minimizing hydraulic shock within the wellbore. Once released, the ball 110 travels downward to land on and seal against the seat of a downhole plug. This enables pressure to be built up for the next stage of the fracturing operation, ensuring continuity of the stimulation job.

The device 100 can include a collet-based retention system designed to engage and retain the polymer-locked cable during its deployment and monitoring period. The collet fingers 140 are flexible mechanical elements that latch onto the cable 150, holding it in place within the tool 100. Upon actuation of the release device 120, the collet fingers 140 retract or disengage, allowing the cable 150 to be withdrawn manually or via hydraulic or mechanical conveyance. The design of the collet mechanism can be adjusted to accommodate cables of different diameters, cross-sectional geometries (e.g., round, oval, or teardrop-shaped), and material compositions.

The various components of the system may be constructed from a range of materials depending on downhole environmental conditions, mechanical requirements, and intended duration of deployment. For example, the sealing ball 110 may be formed from a variety of materials including, but not limited to dissolvable materials, composite materials, and elastomer-coated cores. Dissolvable materials, such as magnesium or aluminum alloys, can gradually disintegrate in the presence of wellbore fluids over time, reducing the need for milling or retrieval after fracturing. Composite materials, such as phenolic resins and glass-filled epoxy, can provide sufficient mechanical strength to withstand sealing pressures while allowing for eventual milling or fragmentation. Elastomer-coated cores can include an outer elastomeric layer (e.g., nitrile rubber or fluoropolymer) to enhance sealing effectiveness on plug seats that may have minor imperfections.

The release device 120 and collet fingers 140 can be fabricated from corrosion-resistant metals such as stainless steel or titanium alloys. In high-temperature applications or wells with sour gas environments, alloys with high hydrogen sulfide resistance may be selected.

Figure 2:
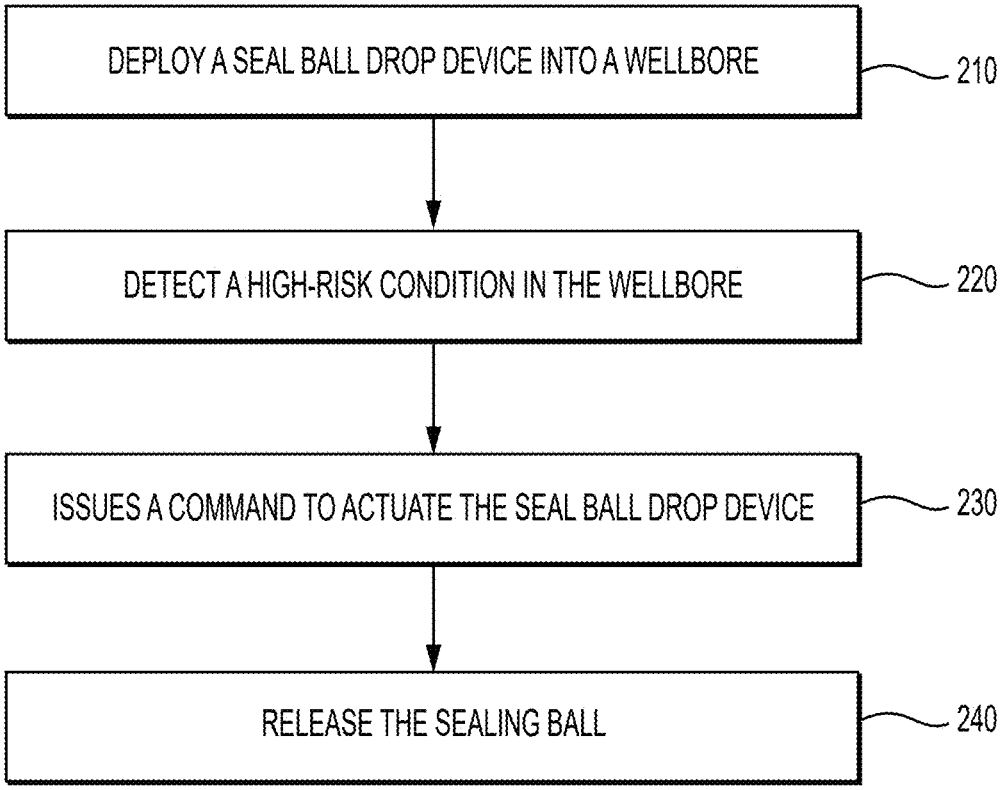
FIG. 2 is an illustration of an example method of operating a seal ball drop device.

FIG. 2 is an illustration of an example method of operating a seal ball drop device 100. At stage 210, the seal ball drop device 100 is deployed into a wellbore using a wireline assembly. The wireline assembly can include one or more of the following: an electrical wireline, slickline, or hybrid conveyance system that includes fiber-optic communication or electrical conductors. The device 100 may be mechanically attached to a fiber-optic cable, typically of the polymer-locked type, which serves as the sensor medium for hydraulic fracture monitoring. In some embodiments, the cable is anchored at multiple points along the wellbore to maintain its spatial orientation for accurate distributed sensing.

The seal ball drop device 100 is positioned at a predetermined depth, proximate to a downhole plug that will be used for stage isolation during the fracturing process. The device 100 may be set in place using a setting tool, locking mechanism, or by mechanical interference fit. In some embodiments, the deployment may occur in a horizontal segment of the wellbore within a lateral section of an unconventional reservoir.

At stage 220, a computing device—located either at the surface, within a control cabin, or remotely at a monitoring center—detects a high-risk condition indicative of potential damage to the deployed cable. The computing device may receive real-time data from the optical fiber via DAS, DTS, or other fiber-optic modalities. These sensor signals can reveal elevated fluid flow rates, abnormal temperature gradients, or pressure transients that correlate with high erosional forces.

Detection algorithms running on the computing device may incorporate thresholds or machine learning models trained to recognize patterns associated with low cluster efficiency or flow channeling. When such a pattern is detected, the computing device identifies that a portion of the cable near the current device location is at risk of erosion, abrasion, or displacement due to excessive fluid velocity or turbulence.

In some implementations, the computing device may also consider inputs from pressure gauges, flowmeters, or downhole imaging tools, and may operate autonomously or under human supervision.

Upon determining that a high-risk condition exists, the computing device can initiate corrective action at stage 230 by issuing a command to actuate the device 100. The command may be transmitted over a physical medium, such as a copper conductor embedded in the wireline, or via fiber-optic encoded signals. In certain embodiments, the device 100 is addressable and configured to respond only to specific signal sequences, thereby allowing selective actuation even when multiple devices are deployed in the wellbore.

The command may include a voltage pulse, current modulation, frequency-coded signal, or a digital communication packet formatted to activate the electrical control board housed within the device 100. This control signal energizes the internal circuitry responsible for triggering the mechanical release system.

Depending on the embodiment, actuation may include energizing a solenoid, melting a fusible link, rotating a release collar, or displacing a locking pin that holds the sealing ball in place.

At stage 240, in response to the actuation signal, the device 100 releases the sealing ball 110. The sealing ball 110 may be held within a receptacle, chamber, or latch system in the device body prior to release. When the release mechanism is triggered, the ball 110 is ejected or allowed to fall freely under gravity or fluid pressure toward the plug seat located below the device.

In some embodiments, the ball 110 includes one or more pressure-equalization ports that facilitate fluid exchange as the ball descends, thereby reducing hydraulic resistance and ensuring a clean, uncontaminated seal. The ball then lands on the plug seat—a profile-matching seat integrated into a composite or metallic frac plug designed to isolate a specific zone of the wellbore. Once seated, the ball forms a pressure-tight seal that allows pressure to build up above the plug for the purpose of stimulating the next stage of the formation.

The release of the sealing ball permits the cable and the associated monitoring hardware to be disengaged from the wellbore section at risk, enabling retrieval or repositioning without halting the fracturing operation. This operation may be crucial in continuous pumping environments where downtime must be minimized.

Following the ball release and plug seal engagement, the collet mechanism of the device 100 may be configured to disengage from the cable, thereby freeing the tool and associated monitoring hardware for extraction or lateral repositioning. This allows operators to preserve the integrity of the fiber-optic sensing array and continue data acquisition during subsequent fracture stages.

In some embodiments, after completion of the fracturing treatment, the dropped ball 110 may be milled using coiled tubing and a mill bit, or it may be made of a dissolvable material (e.g., magnesium alloy) that gradually degrades in the presence of wellbore fluids, eliminating the need for mechanical removal. The design and material of the ball can be selected based on operational timelines, fluid chemistry, and pressure/temperature conditions.

Figure 3:
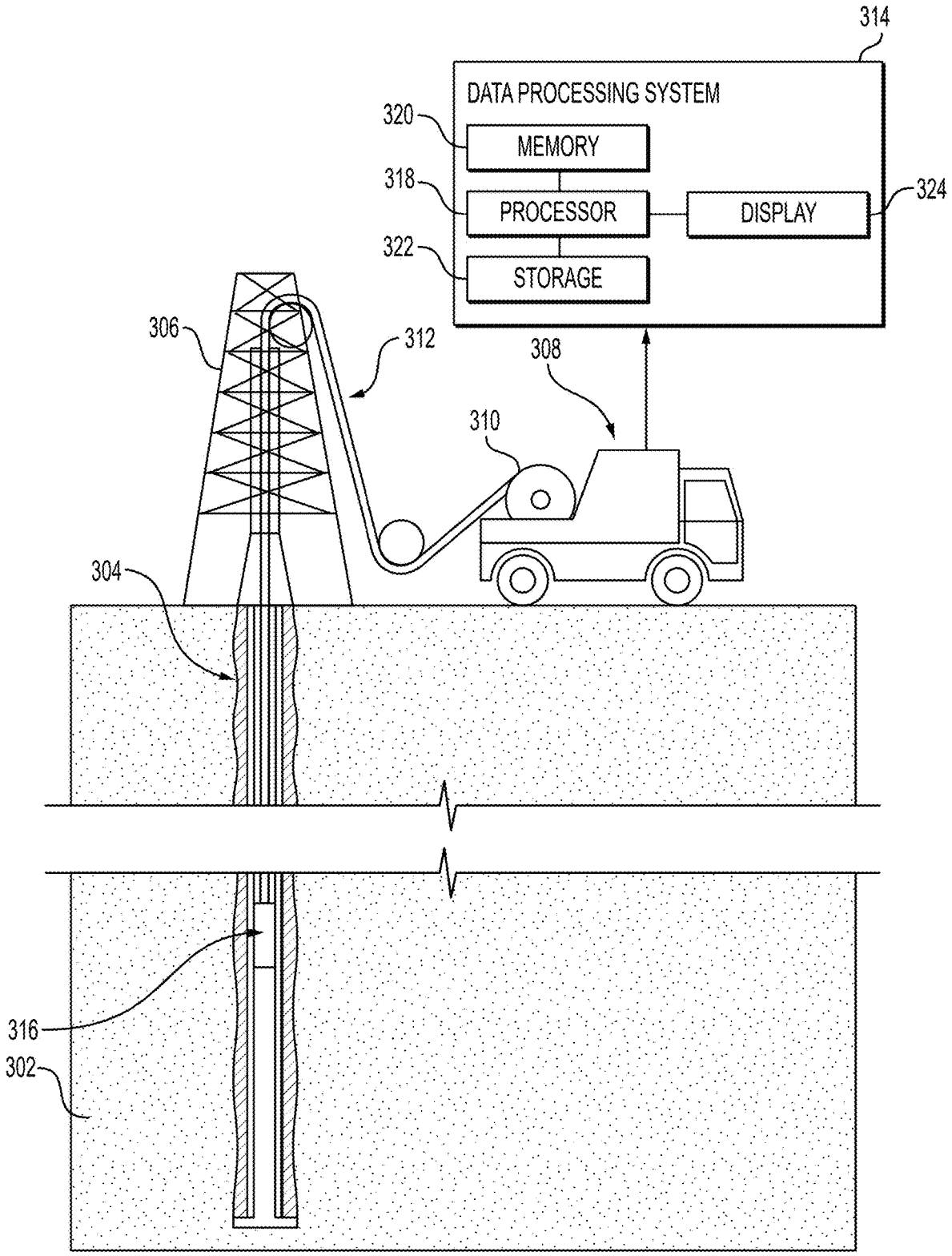
FIG. 3 is an illustration of an example system for operating a seal ball drop device.

FIG. 3 shows an exemplary well site where the present invention can be utilized. A formation 302 has a drilled and completed wellbore 304. A derrick 306 above ground may be used to raise and lower a debris removal assembly (e.g., seal ball drop device 100) into the wellbore 304 and otherwise assist with well operations.

A wireline surface system 308 at the ground level includes a wireline logging unit, a wireline depth control system 310 having a cable 312, and a control unit 314. The cable is connected to a connection assembly 316 that may be lowered downhole. The control unit 314 includes a processor 318, memory 320, storage 322, and display 324 that may be used to display and control various operations of the wireline surface system 308, send and receive data, and store data.

The connection assembly 316 includes equipment for mechanically and electronically connecting the debris removal tool with the cable 312. The cable 312 includes a support wire, such as steel, to mechanically support the weight of the debris removal tool and communication wire to pass communications between the debris removal tool and the wireline surface system 308. The debris removal tool, as described in more detail below, is installed below the connection assembly.

The wireline surface system 308 can deploy the cable 312, which in turn lowers the connection assembly 316 and debris removal tool deeper downhole. Conversely, the wireline surface system 308 can retract the cable 312 and raise the debris removal tool and assembly, including to the surface. The cable 312 is deployed or retracted by the wireline depth control system 310, such as by unwinding or winding the cable 312 around a spool that is driven by a motor.

The wireline logging unit communicates with the control unit 314 to send and receive data and control signals. For example, the wireline logging unit can communicate data received from the debris removal tool to the control unit 314. The wireline logging unit likewise can communicate data and control signals received from the electronic control system 314 to the debris removal tool. In some examples, the wireline logging unit is part of the control unit 314. In other examples, the control unit 314 sends and receives data to and from the debris removal tool directly.

Although FIG. 3 shows the debris removal tool being operated on a cable 312, the debris removal tool can be attached to other types of conveyance systems, such as coil tubing. Any conveyance system can be used to mechanically support the debris removal tool and mechanically raise or lower it within the wellbore 304. References to a "cable" are intended to be non-limiting, instead encompassing any known conveyance system.

In some embodiments, the shaft is fixed in the axial direction and results in axial motion of the housing. These embodiments may include ones where there is a separate concentric housing around the main housing which extends relative to the end of the main housing to accomplish a similar radial, axial, or helical debris stop.

Examples in the present disclosure may also be directed to a non-transitory computer-readable medium storing computer-executable instructions and executable by one or more processors of the computer via which the computer-readable medium is accessed. A computer-readable media may be any available media that may be accessed by a computer. By way of example, such computer-readable media may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers.

Note also that the software implemented aspects of the subject matter claimed below are usually encoded on some form of program storage medium or implemented over some type of transmission medium. The program storage medium is a non-transitory medium and may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The claimed subject matter is not limited by these aspects of any given implementation.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Obviously, many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

What is claimed is:

1. A method of sealing a downhole plug seat, the method comprising:

providing a device, the device comprising:

a ball, a collet attached to the ball, a release device attached to the collet, and an electrical control board attached to the release device;

sending an electrical command signal to the release device;

releasing the collet attached to the release device;

equalizing pressure in the device via at least one pressure port in the ball; and releasing the ball and the collet onto the downhole plug seat.

2. The method of claim 1, further comprising milling the released ball and the released collet at a later time.

3. The method of claim 1, wherein the collet is attached to the release device via collet fingers.

4. The method of claim 1, wherein the electrical control board is powered using one of:

simple voltage; or an addressable switch.

5. The method of claim 4, wherein the electrical control board is powered using the addressable switch, and wherein the addressable switch is activated with the electrical command signal.

6. The method of claim 1, wherein the ball is made up of dissolvable materials.

7. The method of claim 1, wherein the at least one pressure-equalization port further facilitates fluid exchange as the ball descends.

8. A system for sealing a downhole plug seat, the system comprising:

a tool comprising:

a ball;

a collet attached to the ball;

a release device attached to the collet; and an electrical control board attached to the release device;

a processor;

memory accessible to the processor;

processor-executable instructions stored in the memory and executable by the processor to instruct the system to perform stages comprising:

sending an electrical command signal to the release device;

releasing the collet attached to the release device;

equalizing pressure in the tool via at least one pressure port in the ball; and releasing the ball and the collet onto the downhole plug seat.

9. The system of claim 8, the stages further comprising milling the released ball and the released collet at a later time.

10. The system of claim 8, wherein the collet is attached to the release device via collet fingers.

11. The system of claim 8, wherein the electrical control board is powered using one of:

simple voltage; or an addressable switch.

12. The system of claim 11, wherein the electrical control board is powered using the addressable switch, and wherein the addressable switch is activated with the electrical command signal.

13. The system of claim 8, wherein the ball is made up of dissolvable materials.

14. The system of claim 8, wherein the at least one pressure-equalization port further facilitates fluid exchange as the ball descends.

* * * * *